United States Patent [19]

Bellia

[11] Patent Number: 4,858,550

[45] Date of Patent: Aug. 22, 1989

[54] DETACHABLE INFLATABLE BOAT BOTTOM

[76] Inventor: Paul A. Bellia, P.O. Box 60612, San Diego, Calif. 92106

[21] Appl. No.: 148,089

[22] Filed: Jan. 25, 1988

[51] Int. Cl.[4] ..... B63B 39/03

[52] U.S. Cl. ..... 114/345; 114/271; 114/283; 114/291; 114/140; 441/40

[58] Field of Search ..... 441/35, 40, 66; 114/270, 354, 343, 345, 361, 364, 271, 274, 283, 288, 291, 140

[56] References Cited

U.S. PATENT DOCUMENTS

| | | | |
|---|---|---|---|
| 3,451,078 | 6/1969 | Edwards | 114/354 |
| 3,608,112 | 9/1971 | Irgenis | 114/345 |
| 4,427,394 | 1/1984 | Felter | 441/66 |
| 4,528,927 | 7/1985 | Itzuka | 114/345 |
| 4,619,620 | 10/1986 | Felter | 441/66 |
| 4,640,217 | 2/1987 | Ferronniere | 114/345 |
| 4,660,497 | 4/1987 | Cochran | 114/345 |
| 4,724,792 | 2/1988 | Cochran | 114/345 |

*Primary Examiner*—Sherman D. Basinger
*Assistant Examiner*—Clifford T. Bartz
*Attorney, Agent, or Firm*—Frank D. Gilliam

[57] ABSTRACT

A hard shell shaped to intimately cover the bottom of an inflatable raft. The shell is made of various contoured staves or segments joined together. Straps are used to attach the shell to the raft, bow and transom. A combination transom and mounting frame is used in the raft which do not include a built-in transom. The shell not only protects the raft against abrasion and puncture, but also reduces its drag coefficient, contributes to it stability and enhances its directional control.

3 Claims, 5 Drawing Sheets

DETACHABLE INFLATABLE BOAT BOTTOM

FIELD OF THE INVENTION

This invention re 1 boats, inflatable watercraft and accessories therefore, more particularly to the construction and attachment of these accessories.

BACKGROUND OF THE INVENTION

A popular form of recreational watercraft is the inflatable boat. Conventional designs in this category have an inflatable horseshoe-shaped hull member defining the bow and sides of the boat, and a generally flat floor attached to the inflatable horseshoe. The stern of the boat may be an additional inflatable member or a rigid transom to receive an outboard motor for mounting. These boats are typically made of layered materials, one layer to provide an air/watertight seal and another to provide shape, strength and some measure of abrasion resistance. These watercraft allow easy land transportation, being lightweight and foldable into small packages upon deflation. They also are extremely buoyant, allowing use in rough waters or surf and provide added safety for inexperienced recreational users.

This conventional design does have some disadvantages, however. Abrasion limits the life of these craft. Beaching, launching, debris in water and cleaning of the external flexible surfaces tend to abrade the material which leads to failure and/or loss of buoyancy. This type of boat is also frequently used in shallow areas, where bottom scraping is likely, further aggravating the abrasion problem.

A second disadvantage is the limitations on speed. The nonrigid form of the inflatable boat tends to deform under high speed loads. The high buoyancy and nonrigid form also tends to ride on and deform to the shape of the tops of waves, slowing the craft even if streamlined. Maintaining proper streamlined shape under these conditions is difficult at best with an inflatable boat. The higher propulsive forces (outboard motor) for high speed must also be accommodated and distributed along the inflated boat. These forces tend to result in a heavier, less flexible (foldable) structure if the conventional design is continued. The combination of added weight and lack of streamlining requires still heavier and more powerful propulsive means, which further increases weight and decreases portability and economy.

Another disadvantage is the general lack of directional stability. Rigid boats typically have a keel from bow to stern. The keel provides the primary structure to transfer fore/aft loads and provide directional stability against side winds and loads. Inflatable boats lack this rigid load carrying member and directional stability.

In inflatable boats which do not come equipped with a rigid transom, a demountable transom is sometimes provided for attachment to the rear portion of the inflatable fabric surface, for mounting of an outboard motor. A disadvantage with this type of installation is that at high power settings the outboard motor will tend to deform the inflatable supporting structure and drive itself under the boat, limiting speed and efficiency of propulsion. In the instant invention, an additional rigid supporting surface is provided to support the demountable transom, and provide more rigid support for the outboard motor preventing deformation and improving efficiency.

Modifications of inflatable boats have addressed some of these disadvantages. U.S. Pat. No. 3,451,078 teaches that rigid boards can be fitted into the inflatable hull by means of waterproof joints. Boards or joint sections are placed in areas of high loads, or where abrasion resistance and dimensional rigidity are needed. Boards may also provide a keel for the boat. This modification (sealed board sections) allows more limited folding of deflated boat, but adds weight and limits transport size to the board sections. However the major disadvantage is the cost penalty incurred. The waterproof seal required for each board edge and board joint requires additional manufacturing process steps and therefore added cost. The areas between board sections must also be increased in strength and abrasion resistance to allow concentrated and repeated folding, and to transfer loads from one board to another.

Another modification also discussed in U.S. Pat. No. 3,451,078 uses bottom boards fitted above the inflatable hull. These again provide load bearing means, especially in conjunction with outboard motor transoms.

Another type of modification is represented by U.S. Pat. No 4,462,331. This teaches a modified layered construction of inflatable boats to add rigidity and avoid blisters. However, cost and weight penalties are present.

A more drastic design modification changes the inflatable into a semi-rigid boat, as represented by U.S. Pat. No. 4,660,497. A rigid single hull portion is continuously or frequently attached to a number of inflatable bladders below an inflatable boat. This converts the inflatable boat into a rigid bottom craft, which also allows a fixed or hinged attachment of rigid bottom to a transom for motor mounting. Loads can be transmitted, shape maintained, and directional stability achieved. However, the craft is no longer foldable (single section bottom) or fully deflatable. The single rigid hull portion also adds weight. The single hull section may include flotation chambers to aid stability but this increases transport difficulties. In the extreme form of this design, the boat is essentially a rigid hull craft with inflatable bladders.

Another approach is to start with a rigid watercraft and add flexible floats or protectors. This is illustrated in the following U.S. Pat. Nos: 4,667,619; 3,467,345; 3,055,022; 3,220,026; 4,586,451; and 3,270,701. This approach adds relatively lightweight stabilizers, protectors and floats to a rigid boat (or surfboard). However, ease of transport, folding, light weight and other advantages of inflatable boats are lost.

SUMMARY OF THE INVENTION

The principal and secondary objects of this invention are:

to provide a sectioned abrasion resistant bottom attachment for inflatable watercraft;

to provide a streamlined and rigid bottom shape to an inflatable boat to achieve higher speed;

to provide directional stability for inflatable watercraft with bottom attachment;

to provide a rigid mounting member for propulsive means; and to maintain light weight, foldability, low cost and portability of inflatable watercraft and bottom attachment.

These and other objects are achieved by joining panel sections to form a rigid bottom platform. The bottom platform is attached to the inflatable boat at a minimum of two points. The platform provides bottom protection during low speed, beaching or launching operations. At higher speeds the bottom platform provides hydrodynamic streamlining, lift, and structural support of the inflatable boat. The bottom platform also provides additional rigid support for motor mounting structures attached to the inflatable.

The sections of the bottom attachment are hinged or detachably connected to each other to achieve light weight, assembled shape, strength. Panel section size can be as small as necessary for easy transport. Only a limited number of attach points to an inflatable boat is needed because loads are low at low speed and high speed loads are directly absorbed by the rigid assembled bottom attachment. Lower speeds are needed to plane with added bottom lift and rigid structure. A higher speed is therefore achievable at a given propulsive power, or the better efficiency achieved would enable use of a smaller motor to produce the same speeds as the unimproved boat with resulting fuel economy.

Bottom sections may also be interchangeable to fit various shapes of inflatable boats. Bottom assembly may be adapted to inflatable boats with and without rear motor mount transoms. The inflatable boat with the assembled bottom attachment maintains the advantages of low cost, light weight, small space transportability while achieving rigid hull performance in abrasion resistance, speed and directional stability.

DESCRIPTION OF THE PREFERRED EMBODIMENT OF THE INVENTION

Figure 1:
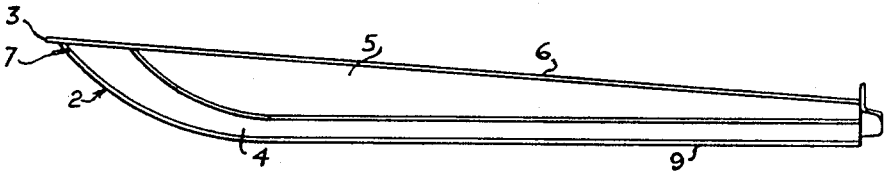
FIG. 1 is a side view of the assembled bottom attachment.

FIG. 1 is a side view of the assembled bottom attachment 2. Bow portion 3 is composed of center panel section 4 and side section 5 which extend the length of the bottom assembly 2. A cushioned edge 6 is provided along the top edge of the bow and side sections of the bottom assembly 2 for a cushioned interface with an inflatable boat (not shown) and to prevent damage if in contact with other objects. Handle 7 is provided for easy transport and towing, and as an attach point to the inflatable boat (not shown for clarity).

Figure 2:
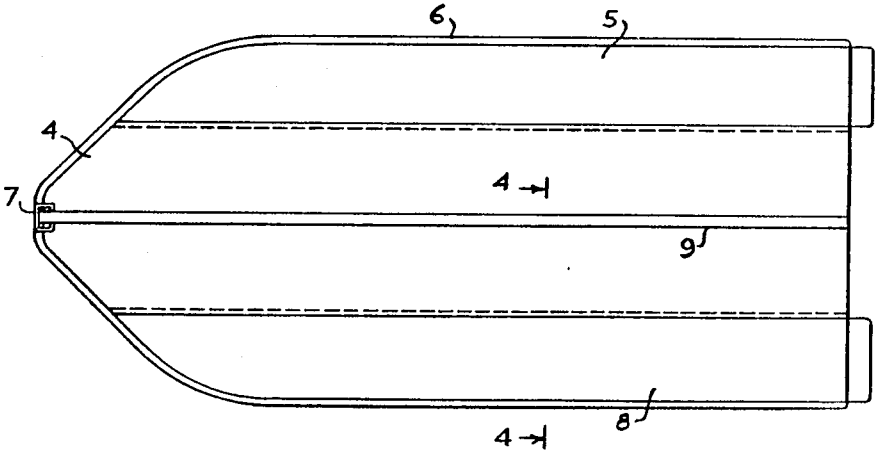
FIG. 2 is a bottom view of assembled bottom attachment.

FIG. 2 is a bottom view of the assembled bottom attachment 2. Center section 4 is shown attached to side sections 5 and 8. Side section 8 is a mirror image of side section 5. Bumper strip 6 extends around the periphery of side sections 5, center section 4 and side section 8. Handle and attach point 7 is shown on the bow of center section 4. Center section 4 also has a keel running from the bow to the aft portion of the bottom assembly 2. The joints between side sections 5 and 8 to center section 4 are not required to be waterproof joints but are load carrying. Keel 9 provides directional stability during forward travel and additional loan carrying capability.

Figure 3:
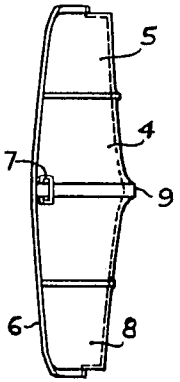
FIG. 3 is a front view of assembled bottom attachment.

FIG. 3 is a front view of the assembled bottom. The bottom shape provides a relatively flat and conforming shape support for the inflatable boat (not shown for clarity). The keel 9 provides a structural member to support the weight and forces during high speed travel. Bumper strip 6 extends around side sections 5, center section 4 and side section 8 to provide a cushion interface and protection from inadvertent contact with other objects. Handle 7 is provided for easy maneuverability in handling and attachment to the inflatable boat (not shown for clarity).

Figure 4:
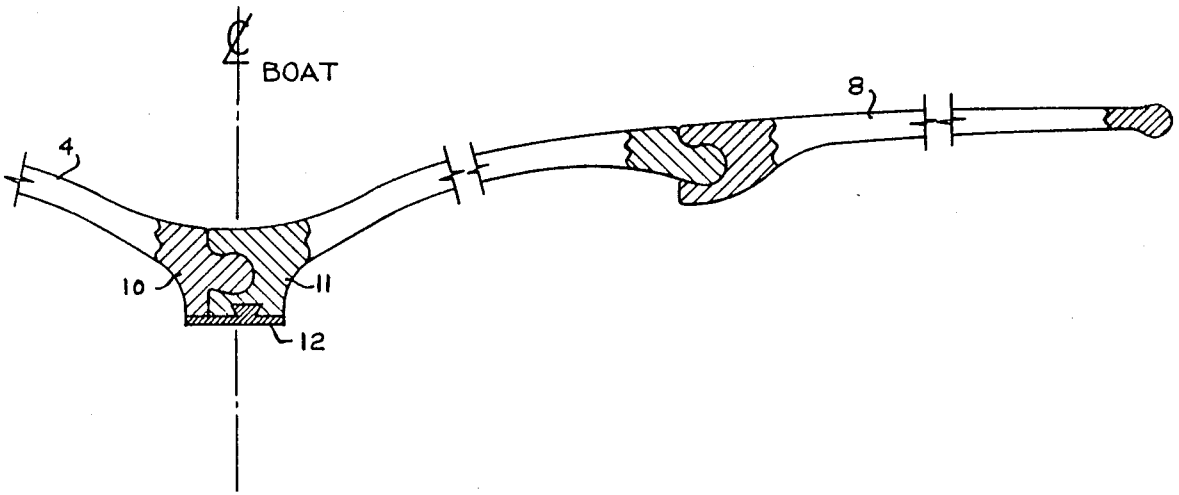
FIG. 4 is a partial cross-section of assembled bottom attachment looking aft.

FIG. 4 is a partial cross-section of the assembled bottom looking aft. Center section 4 is composed of segment 10, segment 11 and abrasion strip 12. Segment 10 and segment 11 are attached using a tongue-and-groove design, or any similar joinder or interlocking edge design. Abrasion strip 12 can be adhesively attached to the joint or mechanically attached as shown in FIG. 4. Center section 4 is also attached to side section 8 using the tongue-and-groove method. This tongue-and-groove approach is one method which allows easy disassembly but when assembled provides structural integrity and a rigid shape. The joints also provide a smooth surface for the inflatable boat.

Figure 5:
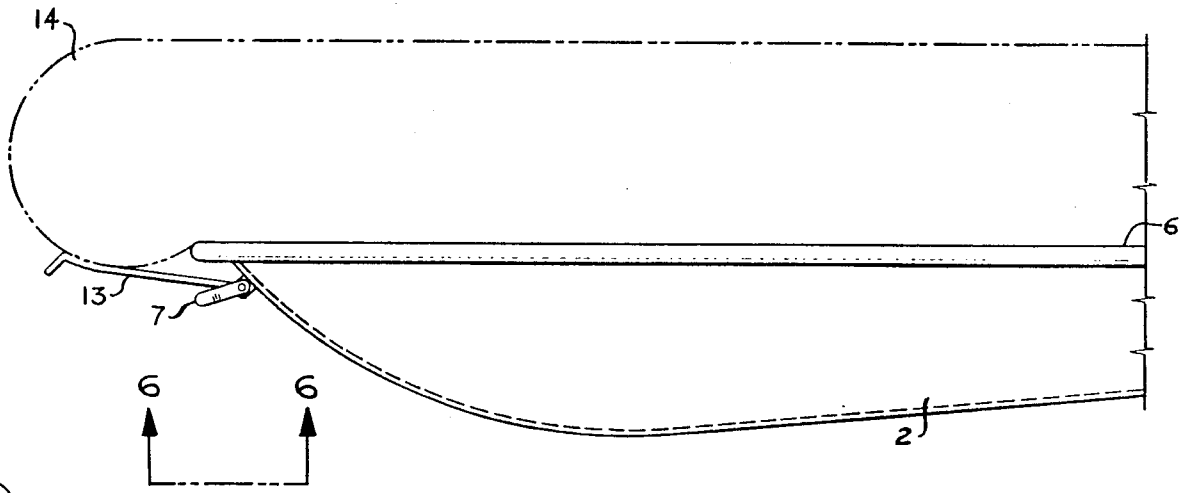
FIG. 5 is a partial side view of assembled bottom attached to an inflatable boat.

FIG. 5 is a partial side view of the assembled bottom attached to an inflatable boat. Handle 7 provides an attach point for strap 13 which is attached to the inflatable boat 14 (shown dotted for clarity). When out of the water, as shown in FIG. 5, the inflatable boat rests in the top of the assembled bottom 2. When in the water the assembled bottom would be supported by the inflatable boat 14 at strap 13, unless panel sections were made from buoyant materials.

Figure 6:
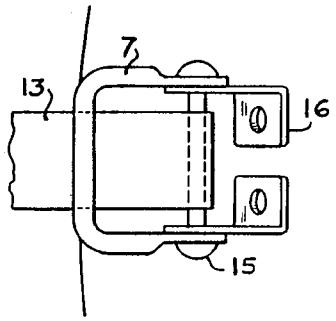
FIG. 6 is a partial bottom view of one means of attaching assembled bottom to an inflatable boat.

FIG. 6 is a partial bottom view of the handle means of attaching assembled bottom to an inflatable boat. Strap 13 is attached to pin 15 which also attaches handle 7 to a bracket 16. Bracket 16 is then mechanically attached to the center section 4 (assembly not shown for clarity). Pin 15 accommodates different support directions and lengths of strap 13, allowing support bottom 2 to adapt to various sizes of inflatable boats 14 (not shown for clarity). Handle 7 also provides a convenient way of handling the bottom and the inflatable raft when on land.

Figure 7:
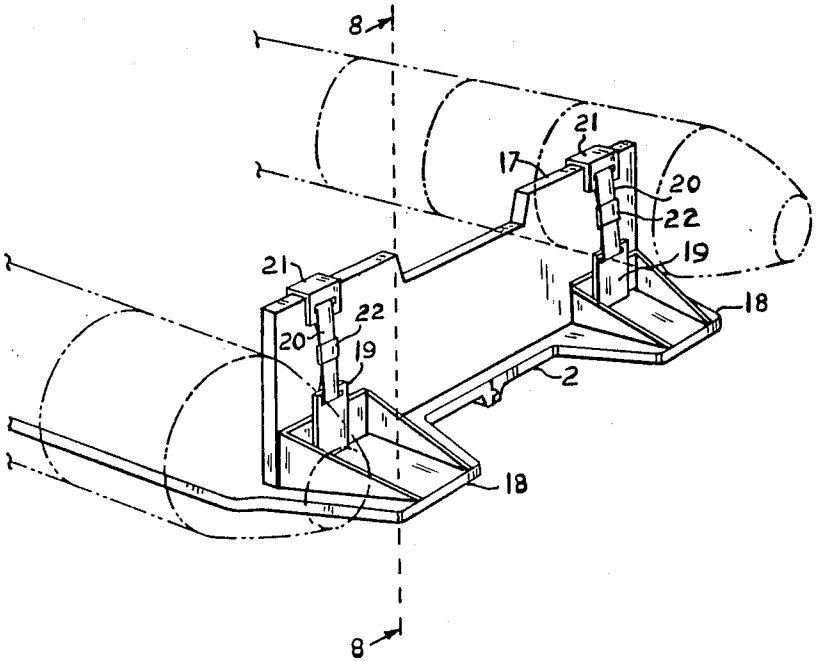
FIG. 7 is a partial perspective view of the aft end of assembled bottom attached to an inflatable boat.

FIG. 7 is a partial perspective view of the aft end of the assembled bottom attached to an inflatable boat. This particular embodiment of the inflatable boat includes a fixed wooden transom 17 attached between the two horseshoe-shaped cylindrical portions of the boat (shown as dotted). The wooden transom 17 provides a rigid platform for mounting of an outboard motor (not shown for clarity). Bottom assembly 2 extends beyond the end of transom 17 to provide convenient attachment points as well as a longer bottom water-line. The two extended portions 18 serve as trim tabs to aid in the stability and maneuverability of the inflated craft. Bracket 19 are provided in the assembly 2 for straps 20 bottom water-line. The two extended portions 18 serve as trim tabs to aid in the stability and maneuverability of the inflated craft. Bracket 19 are provided in the assembly 2 for straps 20 and clamps 21 to attach to wooden transom 17. Buckles 22 provide adjustment for various sizes of transom 17.

Figure 8:
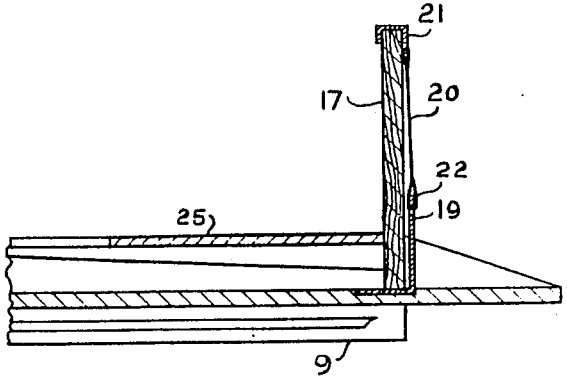
FIG. 8 is a partial cross-section of the aft end of an assembled bottom and an inflatable boat with a rigid transom.

FIG. 8 is a partial cross-section of the aft end of an assembled bottom and inflatable boat with a rigid transom. Transom 17 provides attachment to the bottom 2 which includes keel 9, trim tabs 18 and bracket 19. Bracket 19 is attached by straps 20 and hook 21 to the top of transom 17. Also shown in this embodiment for clarity, but not as a part of the invention, is a wooden floor placed inside the boat for additional rigid structural support of the inflatable boat. The inserted floor provides a walking surface for personnel to prevent abrasion and excess loads on the inflatable craft.

Figure 9:
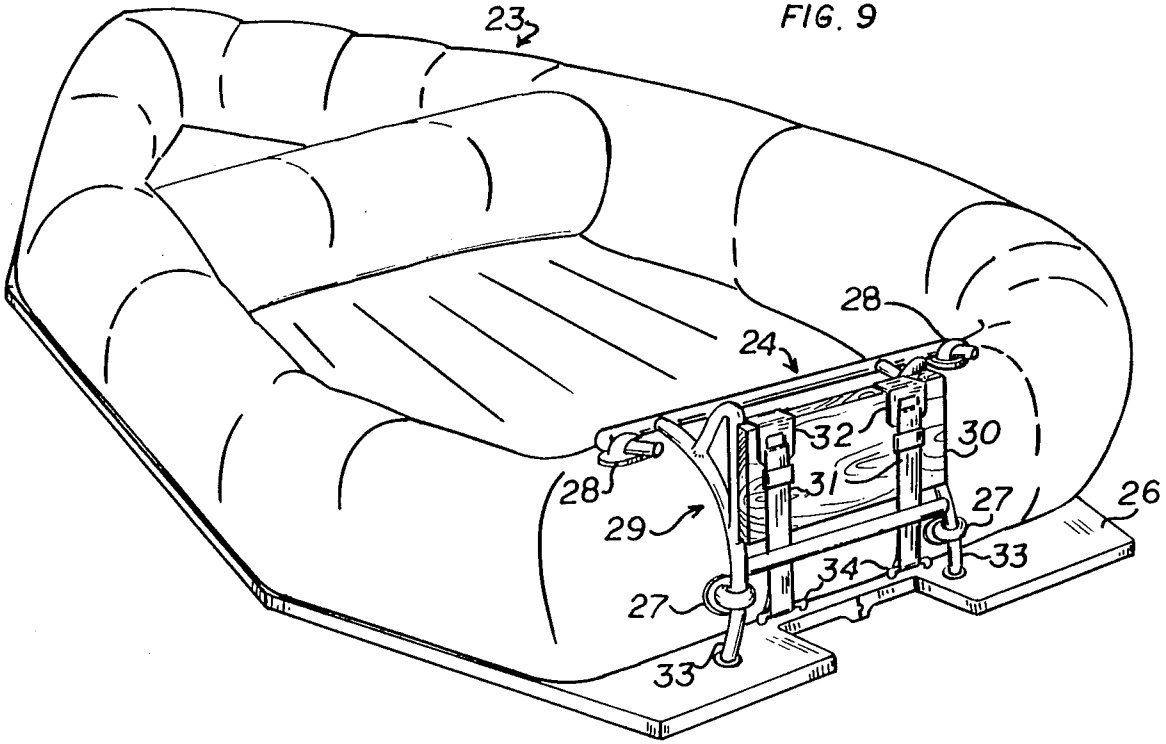
FIG. 9 is a partial perspective view of the aft end of an inflatable boat without an installed rigid transom, showing a demountable transom motor mount and its supporting connection provided by the bottom platform.

FIG. 9 is a perspective view of the aft end of an inflatable boat 23 equipped with a add-on transom assembly 24, and a flat bottom 25. Pairs of eyelets 27, 28 bonded to the walls of the boat are used to attach a metalic frame 29 to the inflatable raft 23. The frame 29 distributes the loads from a short transom 30 to the inflatable boat and to the detachably connected bottom 26. Adjustable straps 31 and brackets 32 are used to fasten the aft-end of the bottom 26 to the transom assembly 24. The straps 31 engage loops 34 associated with the hard bottom 26 and pull its aft edge against the underside of the raft and against the feet 33 of the frame 29. Bottom platform 26 in this embodiment is shown with two segments rather than the three primary segments as previously shown.

While the preferred embodiments of the invention have been described and modifications thereto have been suggested, other applications and modifications could be made without departing from the spirit of the invention and the scope of the appended claims.

What is claimed is:

1. In combination with an inflatable boat having a bow and bottom surface spanning a hull, said hull made of at least one inflatable generally cylindrical bladder defining said bow and starboard and port sides, a detachable bottom assembly which comprises:

a plurality of rigid selectively attachable and detachable bottom segments;

means for removably joining edges of said segments to form said bottom assembly comprising interlocking each side of said segments;

said segments when joined along their edges being generally shaped and dimensioned to conform to said bow and bottom surface, providing both longitudinal and transverse rigidity between said segments and forming a bow which is capable of providing hydrodynamic lift to said inflatable boat when propelled through water; and means for removably attaching said bottom assembly to said hull, said means for removably attaching said bottom assembly comprises a ring secured to the front edge of said bottom assembly and at least one strap engaging said ring and a part of said hull.

2. The invention as defined in claim 1 wherein the bottom assembly extends rearwardly from said hull.

3. The invention as defined in claim 2 wherein a trim tab is located on the distal end of the rearwardly extension whereby greater than normal inflatable boat stability and maneuverability is achieved.

* * * * *